United States Patent [19]

Belinsky

[11] 4,017,109

[45] Apr. 12, 1977

[54] HOISTING DEVICE FOR A CRANE

[76] Inventor: Sidney I. Belinsky, 40 Waterside Plaza, New York, N.Y. 10010

[22] Filed: Jan. 7, 1976

[21] Appl. No.: 647,197

[52] U.S. Cl. ..... 294/67 AA
[51] Int. Cl.[2] ..... B66C 1/16
[58] Field of Search ..... 294/67 AA, 67 A, 67 C, 294/67 R, 81 R, 78 A, 86 LS; 214/77 R, 83.26, 1 R, 1 H, 162, 127; 212/48, 49; 280/758; 74/394

[56] References Cited

UNITED STATES PATENTS

| | | | |
|---|---|---|---|
| 841,443 | 1/1907 | Richards | 74/395 |
| 1,756,106 | 4/1930 | Swenson | 212/49 |
| 3,675,961 | 7/1972 | Wheeler | 294/67 R |

*Primary Examiner*—James B. Marbert

[57] ABSTRACT

A hoisting device for a crane employing purely mechanical members to counterbalance the load on it boom in near horizontal position as the weight of the load is applied in the initial lifting operation. The horizontal position of the boom affords a capability for the associated crane to remove a load, for example, from under a roof, thus giving the crane an access which it would not otherwise have. A planetary gearing system is actuated in accordance with the inclination angle of the boom under load conditions and, as a consequence, a counterweight is automatically moved oppositely in direction from the load to effect the desired balance for the system.

2 Claims, 3 Drawing Figures

HOISTING DEVICE FOR A CRANE

The present invention relates to hoisting apparatus and, in particular, to such apparatus which is capable of removing a load from locations into which it must have horizontal acess.

The invention contemplates a hook accessory for a crane, with a counterweight for the load on the boom which is controlled exclusively by mechanical components in direct and automatic response to the load in accordance with the weight of the load on the boom and its angle of inclination. Under unloaded conditions the counterweight is directly under the pivot axis of the boom, but as the crane begins to lift one end of the boom thus altering its inclination, the counterweight moves sufficiently to place the system in balance at which point the load on the other end of the boom begins to lift. The instant apparatus with its boom in substantially horizontal position on being raised by the crane with its load attached hereto is operative for the purpose of loading and unloading under roofs of buildings and into and from railroad cars, trucks, cargo ships and the like. Due to the fact that the structural parts are mechanical exclusively without any need for additional power to move the counterweight the arrangement is simply designed and can be manufactured economically and operated efficiently. That is, there is no need for electric power required in comparable devices presently in use.

One object of the invention is to provide an efficient hoisting apparatus adapted to be coupled to a crane capable of safely handling large loads under all normal boom angles of inclination.

Other objects and advantages of the invention may be appreciated on reading the following detailed description of one of its embodiments which is taken together with the accompanying drawings, in which.

Figure 1:
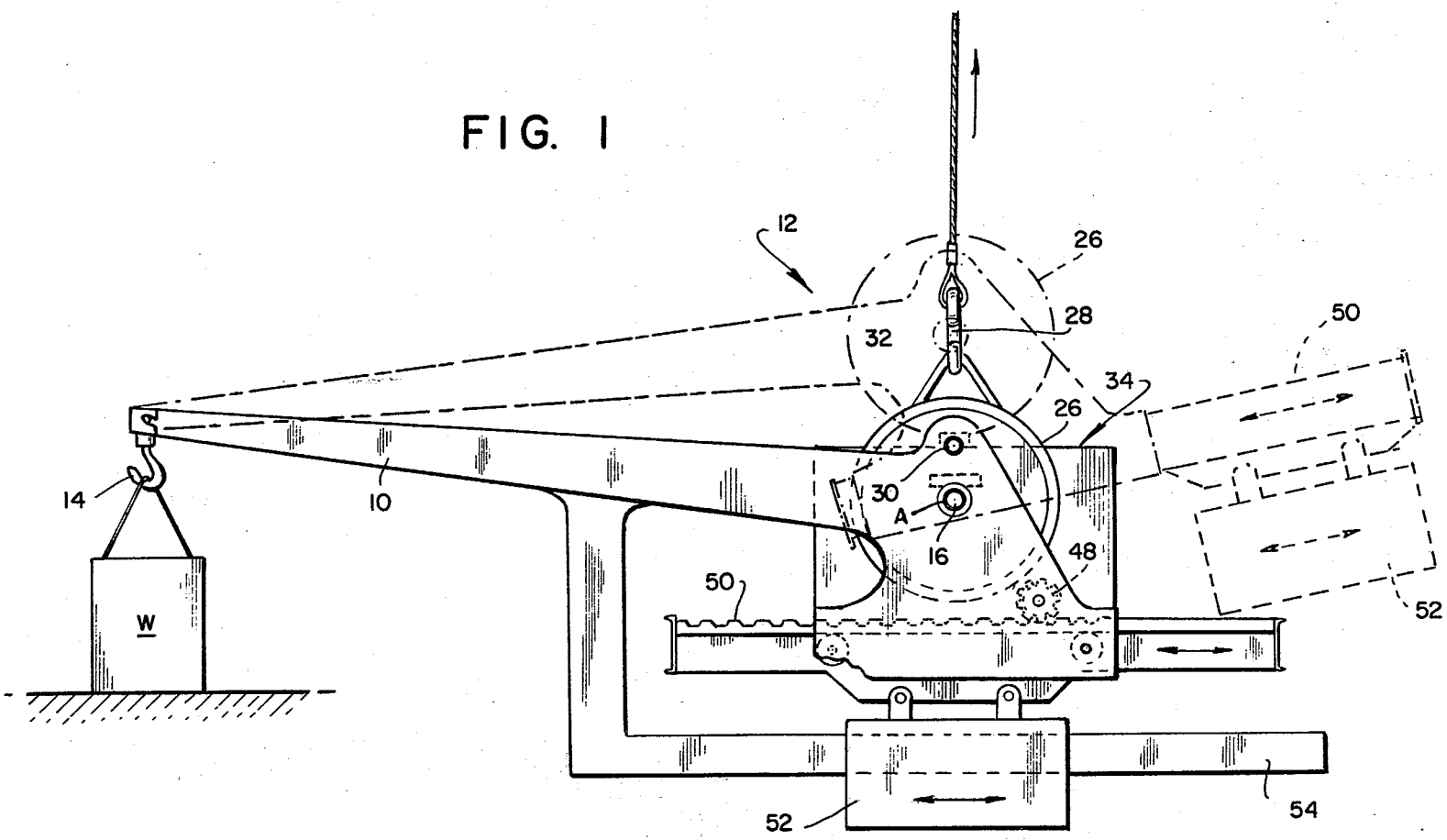
FIG. 1 is a side elevation of the hoisting device.

Referring to the drawings boom 10 of the crane accessory 12 is pivoted to an angle of inclination depending on weight W which is suspended from hook 14 at the end of the boom 10. The boom is pivoted on its main axis A on which main shaft 16 is disposed.

Figure 2:
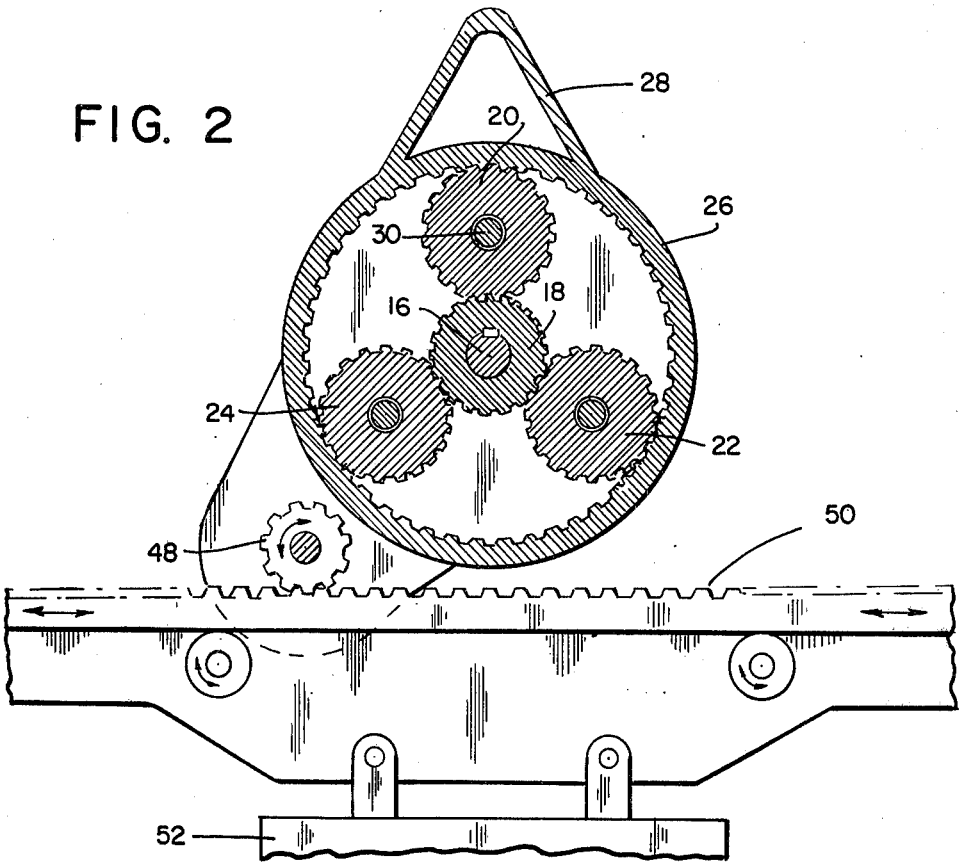
FIG. 2 is a section taken on the line 2—2 of FIG. 3 showing the planetary gear system correlating the load boom by the device and its counterweight.
Figure 3:
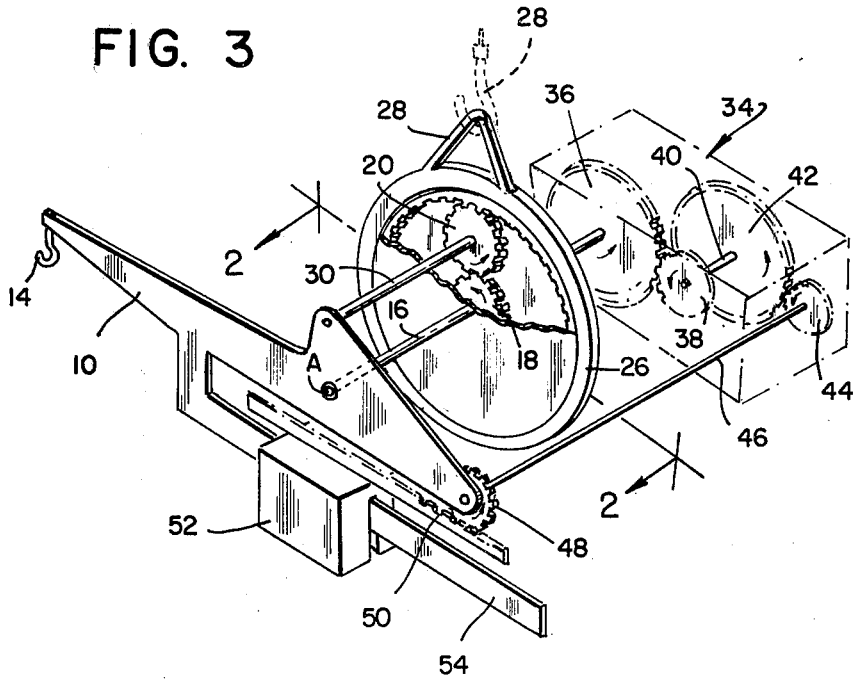
FIG. 3 is a schematic diagram showing the gearing system for the apparatus.

Mounted on the shaft 16 is main gear 18, see FIG. 2, which is in engagement with satelite gears 20, 22 and 24. The gear 20 is in driver engagement with planet gear 26, the gearing system and the boom being supported by crane hook 28. The satelite gear 20 is journalled on a swing shaft 30 connected to the boom 10 and as the boom 10 is tilted under the weight of the load the gear is caused to rotate on the planet gear and drive main gear 18 mounted on main shaft 16 which is in driving connection with multiplicator 34.

The multiplicator 34 has a gear 36 mounted on the shaft 16 in driving connection with reduction gear 38 mounted on the shaft 40. Also mounted on the latter is gear 42 which engages reduction gear 44. The latter is mounted on one end of shaft 46 on the other end of which is mounted pinion 48 engaging rack 50.

The rack 50 is attached to the top of counterweight 52 slidably carried by guide 54. In operation it can be seen that as the boom is tilted under the weight of its load as the device is lifted by the crane the shaft 46 is automatically turned by means of the planetary gear system and the multiplicator 34 to shift the counterweight 52 which is caused under this condition to slide in a direction opposite to the load so as to balance the weight of the load. It is understood that such balance is essential to maintain the boom in near horizontal position in raised and loaded condition.

Various modifications of the invention may be effected by persons skilled in the art without departing from the scope and principle thereof as defined in the appended claims.

What is claimed is:

1. A hoisting device including a pivotal boom, a swing shaft attached to said boom off its axis of pivot, a sun gear mounted on said swing shaft, a planet gear having internal teeth engaging said sun gear, a member adapted to receive a hoisting hook mounted atop said planet gear, a main shaft journalled in said boom, a main gear engaging said sun gear and mounted on said main shaft, a slide secured to the underside of said boom, a counterweight supported on said slide being normally positioned under the journalled end of the main shaft when the boom is unloaded and means actuated by said main shaft for shifting the counterweight from its normal position when said boom is loaded and as the device is hoisted.

2. A device as defined in claim 1 wherein said means includes a multiplicator gear system and a rack and pinion gear in direct control of said counterweight.

* * * * *